US011371261B2

(12) United States Patent
Shimon et al.

(10) Patent No.: US 11,371,261 B2
(45) Date of Patent: Jun. 28, 2022

(54) SOLENOID ACTUATED LOCKING SYSTEM

(71) Applicants: Benjamin Nathan Shimon, Wauwatosa, WI (US); Francis R. Byle, Hubertus, WI (US)

(72) Inventors: Benjamin Nathan Shimon, Wauwatosa, WI (US); Francis R. Byle, Hubertus, WI (US)

(73) Assignee: TLX Technologies, LLC, Pewaukee, WI (US)

( * ) Notice: Subject to any disclaimer, the term of this patent is extended or adjusted under 35 U.S.C. 154(b) by 818 days.

(21) Appl. No.: 16/148,655

(22) Filed: Oct. 1, 2018

(65) Prior Publication Data

US 2019/0100941 A1 Apr. 4, 2019

Related U.S. Application Data

(60) Provisional application No. 62/567,837, filed on Oct. 4, 2017.

(51) Int. Cl.

| | |
|---|---|
| ***E05B 47/00*** | (2006.01) |
| ***E05B 47/02*** | (2006.01) |
| ***E05B 65/00*** | (2006.01) |

(52) U.S. Cl.

CPC ..... *E05B 47/0004* (2013.01); *E05B 47/0038* (2013.01); *E05B 47/026* (2013.01); *E05B 65/005* (2013.01); *E05B 2047/0069* (2013.01); *E05B 2047/0094* (2013.01); *E05Y 2900/31* (2013.01)

(58) Field of Classification Search

CPC .. E05B 47/00; E05B 47/0002; E05B 47/0003; E05B 47/0004; E05B 47/0038; E05B 47/02; E05B 47/026; E05B 2047/0069; E05B 2047/0094; E05B 65/005; Y10T 70/7051; Y10T 70/7057;

(Continued)

(56) References Cited

U.S. PATENT DOCUMENTS 4,656,850 A * 4/1987 Tabata ..... E05B 47/0673 292/144
4,677,834 A * 7/1987 Hicks ..... E05B 47/0002 292/144

(Continued)

FOREIGN PATENT DOCUMENTS

DE 102004030362 A1 * 2/2006 ..... E05B 47/0002
DE 202011104184 U1 * 12/2011 ..... E05B 47/0002

(Continued)

OTHER PUBLICATIONS

"What are Latching Solenoids?," Dec. 28, 2016, Magnet-Schultz of America (Year: 2016).*

*Primary Examiner* — Alyson M Merlino
(74) *Attorney, Agent, or Firm* — Reinhart Boerner Van Deuren P.C.

(57) ABSTRACT

A locking system and a method for using the same are provided. The locking system including a solenoid actuated locking mechanism. The locking mechanism having an armature coupled to a first end of a bell crank and a locking pin coupled to a second end of the bell crank. The activation of the solenoid linearly drives the armature in a first direction along a first axis and the locking pin in a first direction along a second axis where the first axis is generally perpendicular to the second axis.

21 Claims, 5 Drawing Sheets

(58) Field of Classification Search
CPC ..... Y10T 70/7062; Y10T 70/7113; Y10T 292/1021; Y10T 292/11
See application file for complete search history.

(56) References Cited

U.S. PATENT DOCUMENTS

| | | | | | |
|---|---|---|---|---|---|
| 5,044,678 | A | | 9/1991 | Detweiler | |
| 5,228,730 | A | * | 7/1993 | Gokcebay | E05B 47/0002 292/144 |
| 5,339,662 | A | * | 8/1994 | Goldman | E05B 47/0002 70/277 |
| 5,382,763 | A | * | 1/1995 | Martus | E05B 81/14 200/283 |
| 2001/0027671 | A1 | | 10/2001 | Davis | |
| 2006/0042334 | A1 | * | 3/2006 | Huang | E05B 47/0002 70/279.1 |
| 2014/0021843 | A1 | | 1/2014 | Hashemi et al. | |
| 2017/0016250 | A1 | | 1/2017 | Sümegi et al. | |

FOREIGN PATENT DOCUMENTS

| | | | | | |
|---|---|---|---|---|---|
| EP | 1870545 | A2 | * | 12/2007 | E05B 47/026 |
| WO | WO-9934079 | A1 | * | 7/1999 | E05B 47/0002 |

* cited by examiner

SOLENOID ACTUATED LOCKING SYSTEM

CROSS-REFERENCE TO RELATED PATENT APPLICATIONS

This patent application claims the benefit of U.S. Provisional Patent Application No. 62/567,837, filed Oct. 4, 2017, the entire teachings and disclosure of which are incorporated herein by reference thereto.

FIELD OF THE INVENTION

This invention generally relates to a solenoid actuated locking system and method for using the same.

BACKGROUND OF THE INVENTION

Many hotels provide refrigerators in their guest rooms and stock them with an assortment of soda, snacks, or liquor. The guests then have the option to consume, for usually an above market cost, any of the contents of the refrigerator, which is then included in the guest's bill at check-out.

Hotels that stock their refrigerators with items that can be consumed and paid for by the guest will often times have refrigerators that have a built in locking mechanism that locks and unlocks the door of the refrigerator from a centrally located command center, such as the check-in desks at the hotel.

Refrigerators with locking mechanisms prevent members of the hotel staff or other individuals from taking items from the refrigerator when the paying guests are not in the room and then having those items charged to the guest during check-out.

Refrigerators with locking mechanisms can also prevent the child of a hotel guest from accessing the contents of the stocked refrigerator without the consent of the hotel guest.

Refrigerators with locking mechanisms can also allow employees of the hotel to restrict access to a refrigerator stocked with alcoholic beverages if the guests staying in the hotel room are under the legal drinking age of the jurisdiction that the hotel is operating.

However, many refrigerators in the prior art used by hotels include locking mechanisms that are built directly into the refrigerator, which can be undesirable for a number of reasons.

A first problem with prior art refrigerators that have a built in locking mechanism, is that it requires the hotel to purchase a whole new refrigerator in order to implement the ability to lock their refrigerators even if the non-locking refrigerators they currently have still remain functional or have just recently been purchased.

A second problem with prior art refrigerators that have a built in locking mechanism, is that if either the refrigerator or the locking mechanism is broken then an entire new refrigerator unit with a built in locking mechanism will need to be purchased, instead of having the option to replace the broken refrigerator or locking mechanism and continue to use the functioning locking mechanism or refrigerator.

A third problem with prior art refrigerators that have built in locking mechanisms is that the companies who manufacture the refrigerators will often times control the software and system required to lock and unlock the refrigerators from a central network. Therefore, if a hotel purchases locking refrigerators from a first company and becomes dissatisfied with either the performance, function, or operation of the refrigerators and would like to use the locking refrigerators of a second company then the hotel will either need to replace all of the locking refrigerators from the first company with those bought from the second company or they will need to replace them over time while using multiple programs or systems to control the locking refrigerators in each room of the hotel.

Therefore, it would be beneficial to provide a locking mechanism for a refrigerator that can be uninstalled from one refrigerator and installed on another refrigerator with relative ease.

Another problem with locking mechanisms for refrigerators in the prior art is that they require a constant supply of electrical current when the locking mechanism is in the locked position and/or the unlocked position.

As will be understood, this can be quite costly to hotels as they often times have hundreds of guest rooms having refrigerators with locking mechanisms so that constant supply of electrical current to the locking mechanism to keep the refrigerator locked or unlocked can be prohibitively expensive.

Therefore, it would be beneficial to provide a locking mechanism for a refrigerator that did not require a constant supply of electrical current to keep the locking mechanism in the locked position and/or unlocked position.

Another problem with the locking mechanisms in the prior art is that they have bulky designs.

As will be understood, most hotel rooms are small in size which requires the use of miniature refrigerators that have limited storage space.

Therefore, it would be beneficial to provide a locking mechanism that is compact enough to effectively use limited interior space provided by miniature refrigerators by having the locking mechanism couple to the exterior surface of the refrigerator that it is installed on to lock.

Therefore, a locking mechanism for a refrigerator that can be uninstalled from a first refrigerator and installed on a second refrigerator, that provides the user control over the software and systems used by the central control center to lock and unlock the locking mechanism, that provides a means to keep the refrigerator locked and unlocked without the constant supply of electricity, and a locking mechanism that has a sufficiently compact design such that it does not take up the already limited interior space provided by miniature refrigerators is desired.

The invention provides such a locking mechanism for a refrigerator. These and other advantages of the invention, as well as additional inventive features, will be apparent from the description of the invention provided herein.

BRIEF SUMMARY OF THE INVENTION

In one aspect, the present application provides a solenoid actuated locking system comprising a bracket for mounting to a device. The bracket coupled with a locking mechanism. The locking mechanism including a solenoid having an armature. The armature is coupled to a first end of a bell crank and a locking pin coupled to a second end of the bell crank and linearly driving the armature in a first direction causes the locking pin to enter a locked position. Applying a linear force on an angled surface of the locking pin when it is in the locked position causes the locking pin to move in a first direction along a second axis to enter an unlocked position and removing the linear force on the angled portion of the locking pin causes the locking pin to return to the locked position.

According to another aspect of the present application, when a first electrical current is supplied to the solenoid it linearly drives the armature in the first direction and the locking mechanism enters a locked position.

According to another aspect of the present application, when a second electrical current is supplied to the solenoid it linearly drives the armature in the second direction and the locking mechanism enters an unlocked position.

According to another aspect of the present application, the first electrical current will have a polarity that is opposite of the second electrical current.

According to another aspect of the present application, the solenoid is a latching solenoid.

According to another aspect of the present application, an activation switch is provided that is electrically coupled to a central command center and the activation switch provides a signal to the central command center when the locking mechanism is in the locked position.

According to another aspect of the present application, the bell crank will have a notch and the activation switch will have a supervision tab and when the locking mechanism is in the locked position the bell crank suppresses the supervision tab which sends the signal to the central command center indicating that the locking mechanism is in the locked position.

According to still yet another aspect of the present application, a locking system comprising a solenoid coupled that is coupled to an armature. The armature is coupled to a first end of a bell crank and a locking pin is coupled to a second end of the bell crank. The movement of the armature along a first axis causes the movement of the locking pin along a second axis.

According to another aspect of the present application, the first axis is generally perpendicular to the second axis.

According to another aspect of the present application, the armature is coupled to a stationary pole in a latched position.

According to another aspect of the present application, when the armature and the stationary pole are in the latched position the locking mechanism is in the unlocked position.

According to another aspect of the present application, the armature will couple with the stationary pole in the latched position by a permanent magnet.

According to another aspect of the present application, the armature will be unlatched from a stationary pole in an unlatched position.

According to another aspect of the present application, when the armature and the stationary pole are in the unlatched position the locking mechanism is in the locked position.

According to another aspect of the present application, the armature is held in the unlatched position by a spring.

According to another aspect of the present application, applying a linear force to an angled portion of the locking pin causes the locking pin to move in a first direction along a second axis and the removal of the linear force to the angled portion of the locking pin causes the locking to move in a second direction along the second axis.

According to still yet another aspect of the present application, a method for using a solenoid actuated locking system is provided comprising the steps of introducing a first electrical current to a solenoid of a locking mechanism to actuate an armature coupled to a first end of a bell crank along a first axis. Then actuating a locking pin coupled to a second end of the bell crank along a second axis via the actuation of the armature and locking a door as the locking pin is actuated along the second axis.

According to another aspect of the present application, the method further including introducing a second electrical current to the solenoid to retract the armature along the first axis. Then retracting the locking pin along the second axis via the retraction of the armature along the first axis; and unlocking a door as the locking pin is retracted from the locking aperture of the door.

According to another aspect of the present application, the first electrical current has a polarity that is opposite the second electrical current.

According to another aspect of the present application, the armature is latched to a stationary pole by a permanent magnet when the locking mechanism is in the unlocked position.

According to another aspect of the present application, the armature is unlatched from the stationary pole by a spring when the locking mechanism is in the locked position.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
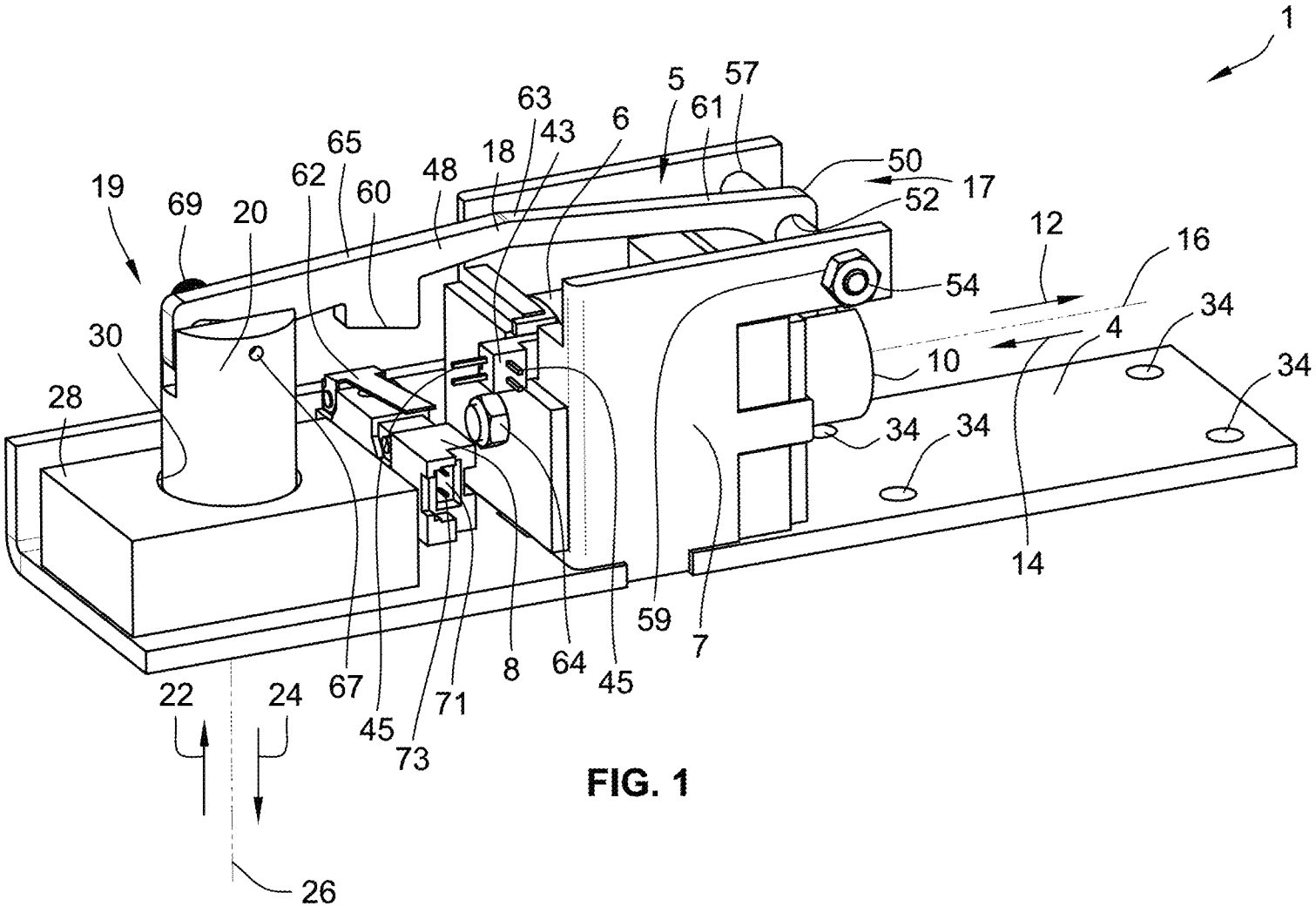
FIG. 1 is a perspective view of a first side of a solenoid actuated locking system in an unlocked position according to one aspect of the present application.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

FIGS. 1-4 illustrate a solenoid actuated locking system 1 (hereinafter "locking system") according to one aspect of the present Application. The locking system 1 allows a user to prevent unauthorized access to a device 2, such as, but not limited to a refrigerator, by locking the door 3 of the device 2.

The locking system 1 has a bracket 4 that is coupled to a locking mechanism 5. The bracket 4 can be coupled directly to a device 2 such that the locking mechanism 5 can prevent the door 3 of the device 2 from opening by moving the locking mechanism 5 from an unlocked position (see FIGS. 1-2) to a locked position (see FIGS. 3-4) and vice versa.

In one embodiment, when the locking pin 20 enters the locked position (see FIGS. 3-4) the locking pin 20 will be directly inserted into a locking aperture 21 of the door 3 of the device 2 to prevent any unauthorized access to the device 2 by the door 3.

In another embodiment, when the locking pin 20 enters the locked position the locking pin 20 abut against the exterior surface of the door 3 of the device 2 to prevent any unauthorized access to the device 2 by the door 3.

Figure 3:
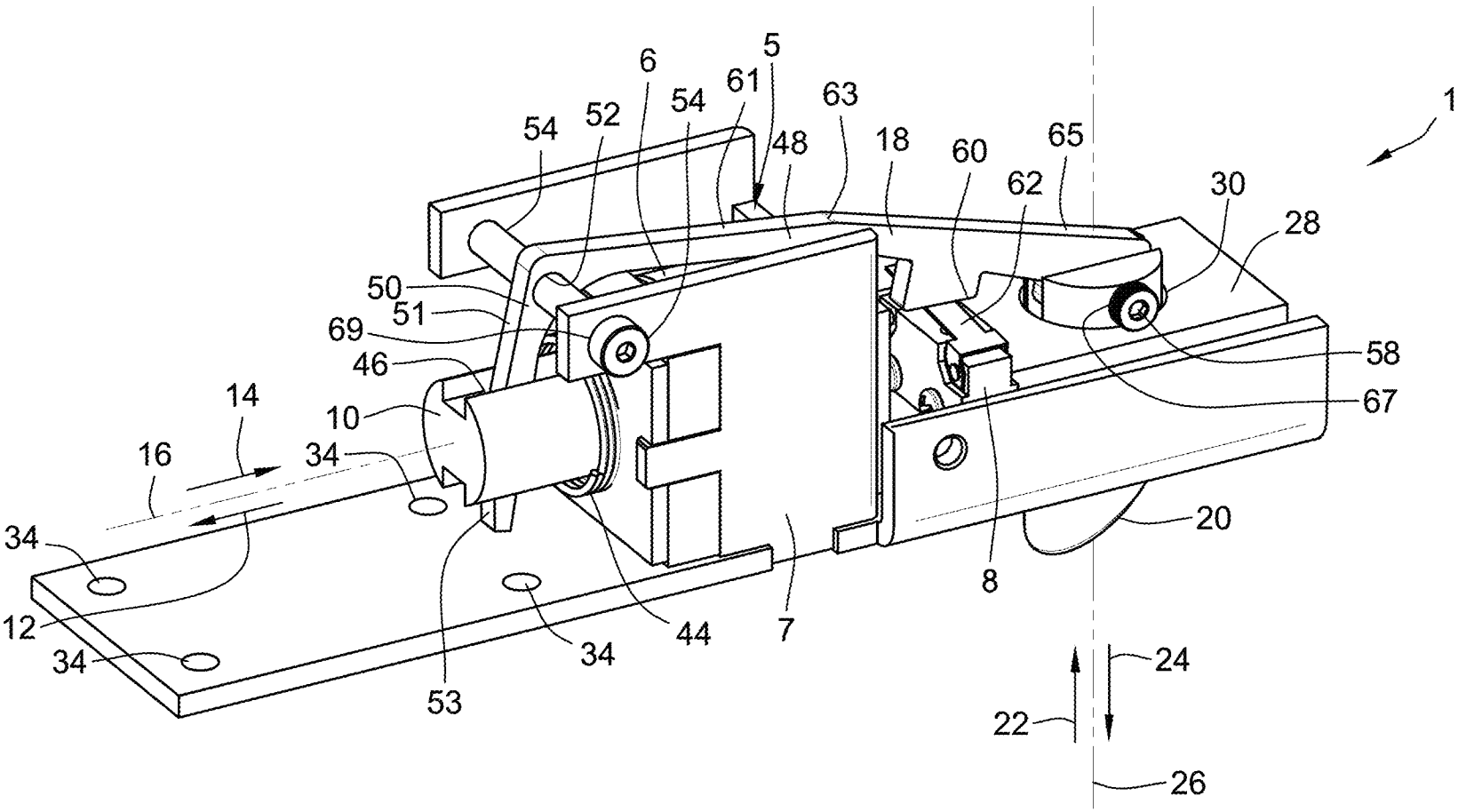
FIG. 3 is a perspective view of a second side of the solenoid actuated locking system of FIG. 1 while in a locked position.
Figure 4:
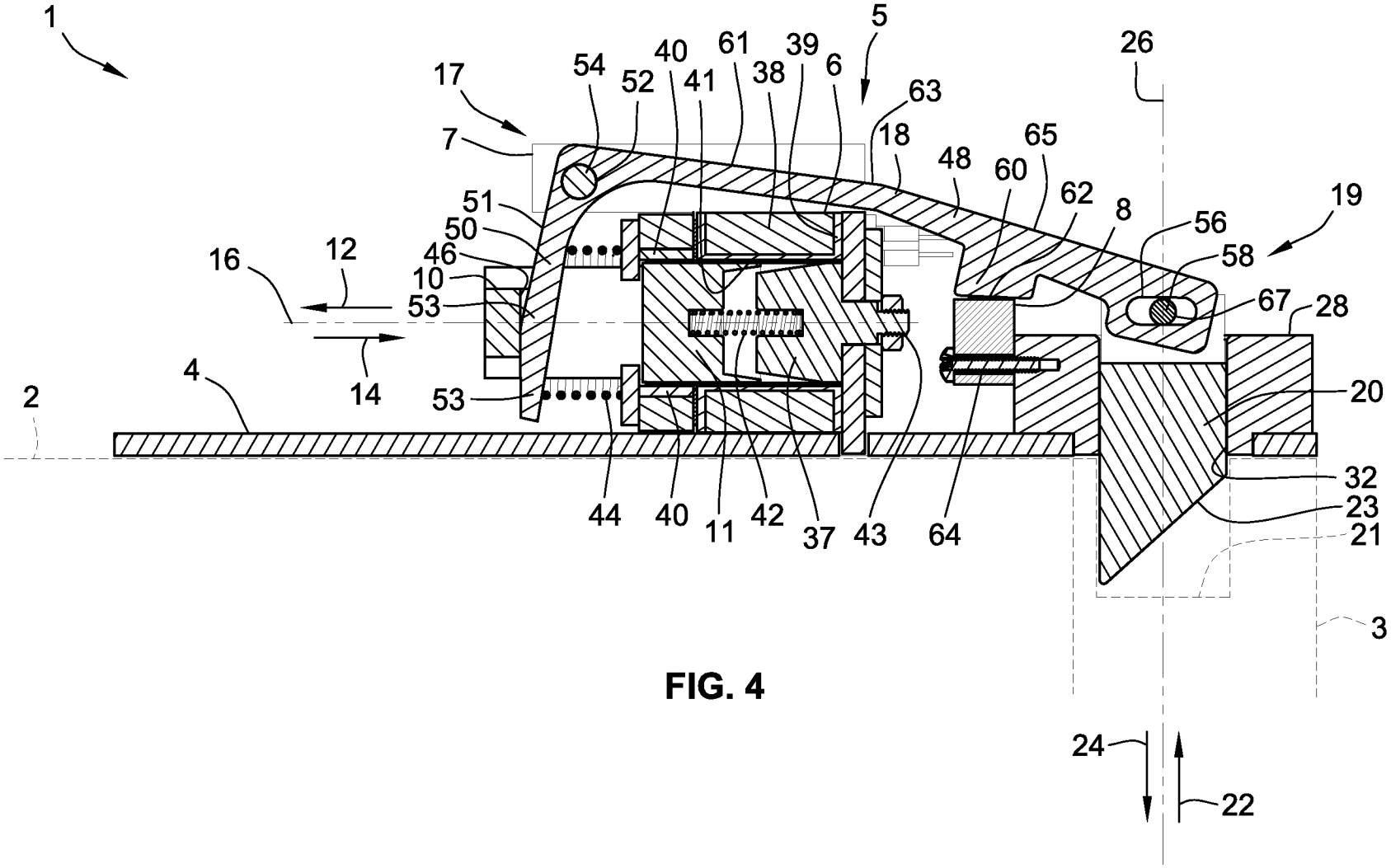
FIG. 4 is a cross-sectional view of the second side of the solenoid actuated locking system of FIG. 3 in a locked position while on the surface of a device.

As illustrated, the locking pin 20 may have an angled portion 23 which allows for a user to shut and lock the door 3 of the device 2 even when the locking pin 20 is in the locked position (see FIGS. 3-4).

The locking system 1 also includes an activating switch 8 that can be a Hall Effect type switch or any other type of switch generally known in the art.

The activating switch 8 may be connected to a central command center or any other electronic control device, such as, but not limited to, a local CPU of an associated device. The activating switch 8 can send a signal to the central command center, such as the front desk of a hotel, or any other electronic device, to inform the user as to whether the locking mechanism 5 is in the unlocked position (see FIGS. 1-2) or the locked position (see FIGS. 3-4).

The locking mechanism 5 also includes a solenoid assembly 6 that is partially surrounded by a housing 7. The solenoid assembly 6 includes an armature 10 that has a coupling portion 11 that is latched to a stationary pole 37 of the solenoid assembly 6 when the locking mechanism 5 is in the unlocked position (see FIGS. 1-2) and unlatches from the stationary pole 37 when the locking mechanism 5 is in the locked position (see FIGS. 3-4).

The armature 10 of the locking mechanism 5 can be actuated in a first direction 12 and a second direction 14 along a first axis 16 via the latching and unlatching of the coupling portion 11 of the armature 10 to the stationary pole 37 and vice versa.

As illustrated, the armature 10 is also coupled to a first end 17 of a bell crank 18 while the second end 19 of the bell crank 18 is coupled to a locking pin 20.

The locking pin 20 can move in a first direction 22 and a second direction 24 along a second axis 26 that is generally perpendicular to the first axis 16 due to the latching and unlatching of the armature 10 with the stationary pole 37.

The locking system 1 also includes a locking bar 28 that includes a locking aperture 30 extending through the locking bar 28. Preferably the locking bar 28 is made of a strong and resilient material, such as, but not limited to, steel or iron, such that the locking pin 20 cannot be easily removed from the locking aperture 30 of the locking bar 28 when the locking pin 20 is in the locked position (see FIGS. 3-4).

The bracket 4 also includes a locking aperture 32 that extends through the bracket 4 and is large enough to allow the locking pin 20 to pass through the bracket 4.

As will be understood, the bracket 4 is also made of a strong and resilient material, such as, but not limited to, steel or iron, such that the bracket 4 cannot be easily deformed in a manner that allows for the unauthorized access to the device 2.

In addition, the bracket 4 also provides coupling apertures 34 to couple the bracket 4 to a surface of the device 2 that is proximate to the door 3 of the device 2, such that the locking pin 20 can lock and unlock the door 3 of the device 2 as locking system 1 goes from the unlocked position (see FIGS. 1-2) to the locked position (see FIGS. 3-4) and vice versa.

The bracket 4 also provides coupling aperture 36 for securing the locking bar 28 to the bracket 4, such that the locking bar 28 will be secured to the device 2 via the coupling of the bracket 4 to the device 2.

Next, the solenoid assembly 6 also comprises a coil 38, a bobbin 39, and permanent magnets 40 as well as a channel portion 41. The channel portion 41 is provided to allow for the movement of the armature 10 in the first direction 12 or the second direction 14 along the first axis 16.

The solenoid assembly 6 also comprises a first spring 42, and a second spring 44 that act to bias the armature 10 depending on if the locking mechanism 5 is in the unlocked position (see FIGS. 1-2) or the locked position (see FIGS. 3-4).

In the illustrated embodiment, the solenoid assembly 6 is a latching solenoid. As will be understood, latching solenoids utilize an electrical current pulse and a permanent magnet 40 to maintain a set position without the constant application of an electrical current.

Further, while the principal of operation is similar to all linear solenoids, latching solenoids are different in that the electrical polarity is important to obtain proper operation.

As the current flows in one direction energizing the coil 38 in the solenoid assembly 6, it adds to the pull of the permanent magnet 40. The armature 10 is attracted to the stationary pole 37 within the solenoid assembly 6.

The armature 10 will shift towards the stationary pole 37 until it abuts the stationary pole 37 where it will be held there by the permanent magnet 40. When the armature 10 is abutting against the stationary pole 37 and being held in place by the permanent magnet 40 the solenoid assembly 6 is considered to be in the latched state.

When the solenoid assembly 6 is in the latched state it will remain in the latched state via the permanent magnet 40 holding the armature 10 in place as it is abutted against the stationary pole 37 until another electrical input is provided by a user to the solenoid assembly 6.

To release the solenoid assembly 6 from this hold position, the permanent magnets 40 attraction has to be cancelled by sending an electrical current back through the coil 38 of the solenoid assembly 6 in an opposite direction.

This electrical current provided to the solenoid assembly 6 will release the hold the permanent magnet 40 has on the armature 10 and the spring 42 of the solenoid assembly 6 will bias the armature 10 in the first direction 12 along the first axis 16 away from the stationary pole 37.

As will be understood, when the armature 10 is released by the permanent magnet 40 and is biased by the spring 42 the solenoid assembly 6 will considered to be in the unlatched state.

In the illustrated embodiment, when the solenoid assembly 6 is in the latched state the locking mechanism 5 will be in the unlocked position (see FIGS. 1-2) and when the solenoid assembly 6 is in the unlatched state the locking mechanism 5 will be in the locked position (see FIGS. 3-4).

In other embodiments according to the principles of the present application, it is envisioned that the solenoid assembly 6 will be in the unlatched state when the locking mechanism 5 is in the locked position and the solenoid assembly 6 will be in the latched state when the locking mechanism 5 is in the unlocked position.

As will be understood, latching solenoids are most efficient when the pulse time is very short compared to the hold time. While a latching solenoid can be used in both short and long stroke applications, the solenoid stroke should be minimized to improve efficiency.

In other embodiments according to the principals of the present application, the solenoid assembly 6 may include, but is not limited to, a pneumatic actuator, a hydraulic actuator, a mechanical actuator, or any other actuator that is generally known in the art.

The locking mechanism 5 also includes a connection port 43 to electrically couple electrical wires to the locking mechanism 5.

In a typical configuration, a first and second electrical wire will be coupled with connection points 45 on the connection port 43. An electrical current can then be sent to the solenoid assembly 6 in order to activate the locking mechanism 5 from the unlocked position (see FIGS. 1-2) to the locked position (see FIGS. 3-4) and vice versa.

In one embodiment, it is envisioned that the locking system 1 will include a multitude of connection ports 43 that electrical wires may be coupled with in order to provide the locking system 1 with electrical current or signals.

In another embodiment, it is envisioned that the locking system will include a multitude of connection points 45 on a single connection port 43 that electrical wires may be coupled with in order to provide the locking system 1 with electrical current or signals.

Next, the bell crank 18 includes a shaft portion 48 extending between a first end 17 of the bell crank 18 and a second end 19 of the bell crank 18.

The shaft portion 48 of the bell crank 18 has a first angled portion 61, an apex portion 63, and a second angled portion 65. The first angled portion 61 extends from the first end 17 of the bell crank 18 to the apex portion 63 and the second angled portion extends from the apex portion 63 to the second end 19 of the bell crank 18.

As illustrated, the first angled portion 61 and the second angled portion 65 have a slope that is angled upward toward the apex portion 63 of the shaft portion 48.

As will be understood, having the first angled portion 61 and the second angled portion 65 sloped upward towards the apex portion 63 provides for greater clearance underneath the bell crank 18, which allows the solenoid assembly 6 to fit underneath the bell crank 18, which provides the advantage of the locking system 1 of the present application having a compact design.

The first end 17 of the bell crank 18 has an arm 50 that extends from the shaft portion 48 of the bell crank 18. The arm 50 of the bell crank 18 has a coupling aperture 52 to receive a spindle 54.

The spindle 54 extends through a first aperture 57 in the housing 7, then through the coupling aperture 52 of the bell crank and then through a second aperture 59 in the housing 7.

As will be understood, once the spindle 54 has been installed through the coupling aperture 52 of the bell crank 18 and the housing 7 the bell crank 18 will be able to rotate about the axis of the spindle 54 via the coupling aperture 52 of the bell crank.

As illustrated, at the second end 19 of the bell crank 18 the locking pin 20 is coupled with the bell crank 18 by inserting a shaft 58 through an opening 67 in the locking pin 20 and an oblong opening 56 of the bell crank 18.

Once the shaft 58 has been inserted through the opening 67 of the locking pin 20 and the oblong opening 56 of the bell crank a coupler 69 is used to secure shaft 58 in place and hold the locking pin 20 and the bell crank 18 together.

As will be understood, the shaft 58 coupling the bell crank 18 and the locking pin 20 can move within the oblong opening provided by the bell crank 18.

As will be appreciated, the movement of the shaft 58 within the oblong opening 56 of the bell crank 18 allows for the locking pin 20 to remain generally parallel with the locking bar aperture 30 and the bracket aperture 32 while the bell crank 18 is stroked between the unlocked position (see FIGS. 1-2) and the locked position (see FIGS. 3-4).

When the locking mechanism 5 moves from the locked position (see FIGS. 3-4) to the unlocked position (see FIGS. 1-2) the armature 10 will be pulled toward the stationary pole 37 in the second direction 14 along axis 16 where it will be abut against the stationary pole 37.

When the armature 10 is being pulled in the second direction 14 along the first axis 16 it will also pull the arm 50 of the bell crank 18 due to the exterior surface 51 of the arm 50 abutting against a stop 46 of the armature 10 along the second direction 14 of the first axis 16.

As will be understood, the contact made between the stop 46 of the armature 10 and the arm 50 of the bell crank 18 while the armature 10 is moving in the second direction 14 along the first axis 16 will also pull the arm 50 of the bell crank 18 in the second direction 14 of the first axis 16.

This movement of the arm 50 of the bell crank 18 in the second direction 14 of the first axis 16 then causes the second end 19 of the bell crank 18 to move in the first direction 22 along the second axis 26, which also causes the movement of the locking pin 20 in the first direction 22 along the second axis 26.

Figure 2:
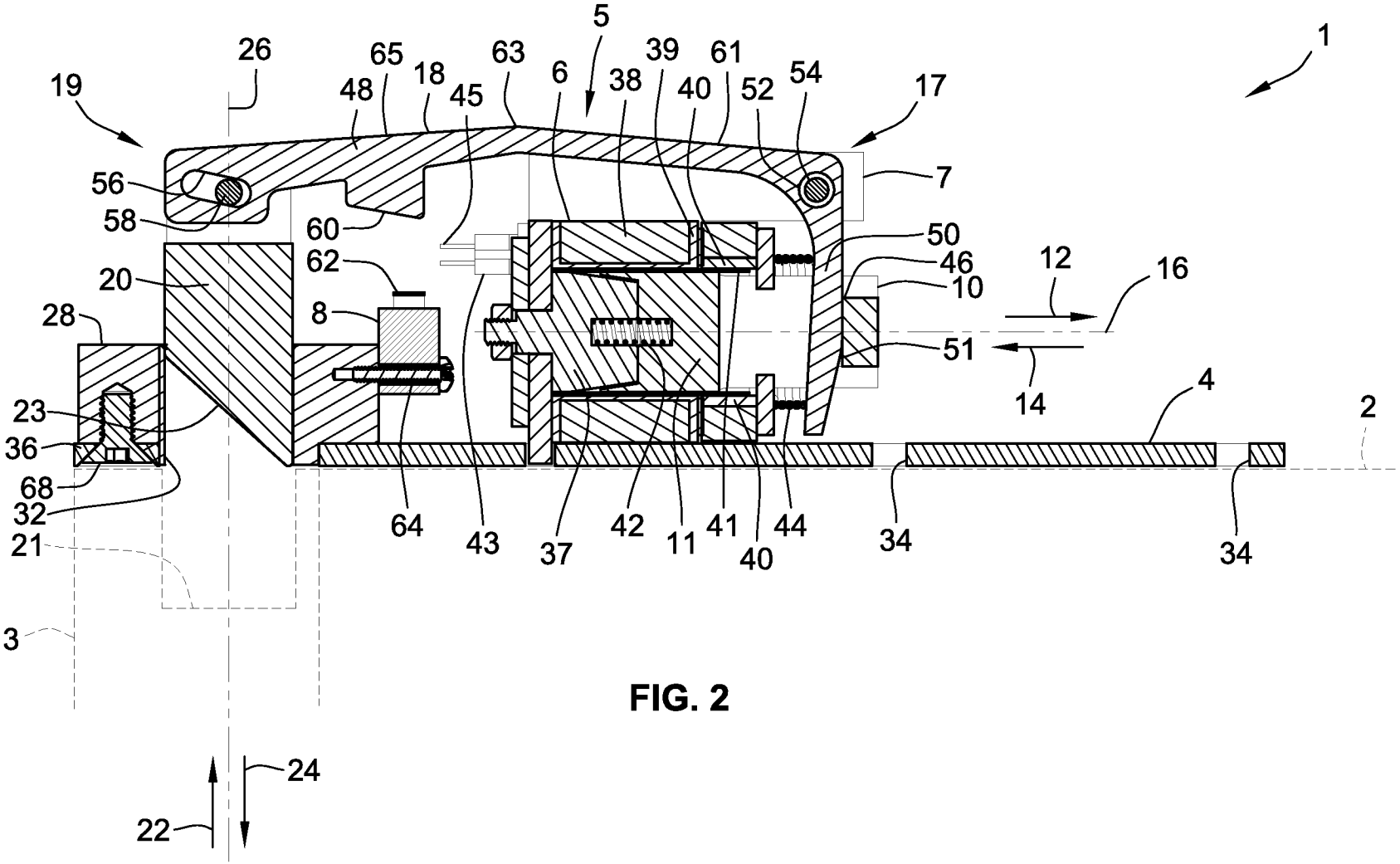
FIG. 2 is a cross-sectional view of the first side of the solenoid actuated locking system of FIG. 1 in an unlocked position while on the surface of a device.

As will be understood, the movement of the locking pin 20 in the first direction 22 along the second axis 26 completes the movement of the locking mechanism 5 from the locked state (see FIGS. 3-4) to the unlocked state (see FIGS. 1-2).

Turning to the activation switch 8, which has a connection port 71 for electrically coupling the connection port 71 to at least one electrical wire.

In a typical configuration, an electrical wire will couple to a connection point 73 of the connection port 71 to provide the activation switch 8 with an electrical current and/or means to send and receive an electrical signal.

In other embodiments, it is envisioned that the activation switch 8 may include a multitude of connection points 73 on a single connection port 71 that may be coupled to electrical wires in order to supply the activation switch 8 with an electrical current and/or to send and receive an electrical signal.

In yet still other embodiments, it is envisioned that the activation switch may include a multitude of connection ports 71 that may be coupled to electrical wires in order to supply the activation switch 8 with an electrical current and/or to send and receive an electrical signal.

The shaft portion 48 of the bell crank 18 has a notch portion 60 that is designed to make contact with a supervision tab 62 of the activation switch 8. The suppression of the supervision tab 62 by the notch portion 60 of the shaft 48 of the bell crank 18 allows a user to monitor if the locking system 1 is in the unlocked position (see FIGS. 1-2) or the locked position (see FIGS. 3-4).

For example, as illustrated in FIGS. 1-2, when locking mechanism 5 is in the unlocked position the notch portion 60 does not make contact with or suppress the supervision tab 62.

However, as illustrated in FIGS. 3-4, when the locking mechanism 5 is in the locked position the notch portion 60 abuts against and suppresses the supervision tab 62.

In some embodiments, the activation switch 8 will be programmed to send an electrical signal via the coupling port 61 to indicate whether the supervision tab 62 is currently being suppressed by the notch portion 60 of the bell crank 18.

As will be understood, by having the activation switch 8 send a signal only when the supervision tab 62 is suppressed, or vice versa, a user at a central command center, such as the check in desk at a hotel, can immediately determine if the locking mechanism 5 of the locking system 1 is currently the unlocked position (see FIGS. 1-2) or the locked position (see FIGS. 3-4).

The activation switch 8 is coupled to the locking bar 28 with a coupler 64 while the locking bar 28 is coupled to the bracket 4 with another coupler 68. In the illustrated embodiments, the couplers 64 and 68 are screws. However in other embodiments, the couplers 64 and 68 can be any coupling means that is generally known in the art.

Still further, it is also envisioned that other embodiments according to the principles of the present application will not require couplers 64 and 68 and the activation switch 8, locking bar 28, and bracket 4 will be formed as a single integral piece.

Turning to FIGS. 1-2, that illustrate the locking system 1 with the locking mechanism 5 in the unlocked position.

As will be appreciated, no electrical current needs to be supplied to the locking mechanism 5 to keep the locking mechanism 5 in the unlocked position (see FIGS. 1-2) because the armature 10 is being held in the latched position with the stationary pole 37 by permanent magnets 40, which in turn holds the bell crank 18 and the locking pin 20 in place in the unlocked position (see FIGS. 1-2).

However, the permanent magnets 40 holding the armature 10 and the stationary pole 37 in the latched position need to be strong enough to overcome the biasing force being applied to the armature 10 by the springs 42, 44 of the solenoid assembly 6.

Turning to FIGS. 3-4, that illustrates the locking system 1 with the locking mechanism 5 in the locked position.

To move the locking system 1 from the unlocked position (see FIGS. 1-2) to the locked position (see FIGS. 3-4) an electrical current is sent to the locking mechanism 5 via the connection ports 43 of the solenoid assembly 6. As discussed above, when a second electrical current having the opposite polarity as the first electrical current is applied to the solenoid assembly 6 it causes a reversal of the magnetic field of the permanent magnets 40 that are latching the armature 10 and the stationary pole 37 together in a latched position.

Therefore, when the second electrical current is sent to reverse the magnetic field of the permanent magnets 40 it causes the armature 10 and the stationary pole 37 to unlatch from one another. As will be understood, the unlatching of the armature 10 from the stationary pole 37 begins the process of the locking mechanism 5 moving from the unlocked position (see FIGS. 1-2) to the locked position (see FIGS. 3-4).

As the armature 10 is unlatched from the stationary pole 37 the spring 42 that was compressed while the armature 10 was latched with the stationary pole 37 will decompress and drive the armature 10 in a first direction 12 along the first axis 16.

After the armature 10 is at least partially extended by the spring 42 it will continue to be biased by the spring 42 to hold the armature 10 in its at least partially extended position along the first axis 16.

As the armature 10 is being driven in the first direction 12 along the first axis 16 it causes the stop 46 of the armature 10 to move in the first direction 12 along the first axis 16.

As the stop 46 moves in the first direction 12 along the first axis 16 it will also allow for the spring 44 biasing against the arm 50 of the bell crank 18 to decompress, which moves the arm 50 of the bell crank 18 in the first direction 12 along axis 16.

The movement of the arm 50 of the bell crank 18 in the first direction 12 along the first axis 16 will cause the first end 17 of the bell crank 18 to rotate about the spindle 54 extending through the coupling aperture 52 of the bell crank 18.

As will be understood, this rotation of the bell crank 18 about the spindle 54 causes the front end 19 of the bell crank 18 to move in the second direction 24 along the second axis 26, which in turn causes the locking pin 20 that is coupled to the front end 19 of the bell crank 18 to also move in the second direction 24 along the second axis 26, which causes the locking mechanism 5 to enter the locked position (see FIGS. 3-4).

As will be understood, if the locking aperture 21 in the door 3 of the device 2 is aligned with the locking pin 20 as it moves along the second direction 24 of the second axis 26 then the locking aperture 21 will receive at least part of the locking pin 20.

Once the locking pin 20 is received in the locking aperture 21 the door 3 will no longer be able to be opened because any movement of the door 3 will be impeded by the locking pin 20 that has been at least partially received in the locking aperture 21.

As will be understood, in the locked position (see FIGS. 3-4) the bell crank 18 along with the locking pin 20 will be held in place by the same biasing force of the spring 44 that keeps the armature 10 in the at least partially extended state and the arm 50 of the bell crank in the first direction 12 along the first axis 16.

Therefore, once the door 3 of the device 2 receives the locking pin 20 the door 3 will remain locked indefinitely without the input of any electrical current beyond the small amount of electrical current to activate the locking mechanism 5 from the unlocked position (see FIGS. 1-2) to the locked position (see FIGS. 3-4).

Then when a user wants to move the locking mechanism 5 from the locked position (see FIGS. 3-4) to the unlocked position (see FIGS. 1-2) they will send another electrical signal to the solenoid assembly 6, which will cause the armature 10 re-latch to the stationary pole 37 and then be held in the latched position via the permanent magnets 40.

As will be understood, the re-latching of the armature 10 to the stationary pole 37 requires that the armature 10 be driven in the second direction 14 along the first axis 16, which will cause the arm 50 of the bell crank 18 to also move along the second direction 14 of the first axis 16.

The movement of the arm 50 will cause the bell crank 18 to rotate about the shaft 54 in a manner that causes the second end 19 of the bell crank 18 to move in a first direction 22 along the second axis 26, which in turn will also cause the locking pin 20 coupled to the second end 19 of the bell crank 18 to move in the first direction 22 along the second axis 26.

This movement of the locking pin 20 along the first direction 22 of the second axis 26 causes the locking mechanism 5 to enter the unlocked position (see FIGS. 1-2) where the locking pin 20 will be retracted from the locking aperture 21 of the door 3.

Once the locking pin 20 has been retracted from the locking aperture 21 of the door 3 the door 3 will be free to be opened by a user to access the interior of the device 2.

As will be understood, when locking mechanism 5 is in the unlocked state (see FIGS. 1-2) permanent magnets 40 keeps the armature 10 and the stationary pole latched together.

Likewise, when the locking mechanism 5 is in the locked position (see FIGS. 3-4) the spring 42 of the solenoid assembly 6 will bias against the armature 10 to keep the armature in the unlatched position and the spring 44 will bias against the arm 50 of the bell crank 18 and keep the exterior surface 51 of the shaft 50 of the bell crank 18 pressed up against the stop 46 of the armature 10 as the stop 46 is at its furthest most position along the first axis 16 in the first direction 12.

As will be understood, the biasing of the armature 10 via the spring 42 and the biasing of the bell crank 18 via spring 44 keep the locking mechanism 5 in the locked position (see FIGS. 3-4) until another electrical signal is sent by a user to the locking mechanism 5.

As will be appreciated, keeping the locking mechanism 5 in the unlocked position (see FIGS. 1-2) via permanent magnets 40 and keeping the locking mechanism 5 in the locked position (see FIGS. 3-4) via the biasing force of the spring 44 allows for the locking system 1 to conserve energy by not requiring the locking system 1 to constantly supply an electrical current to the solenoid assembly 6 to keep the locking mechanism 5 in the unlocked position (see FIGS. 1-2), the locked position (see FIGS. 3-4), or both.

Figure 5:
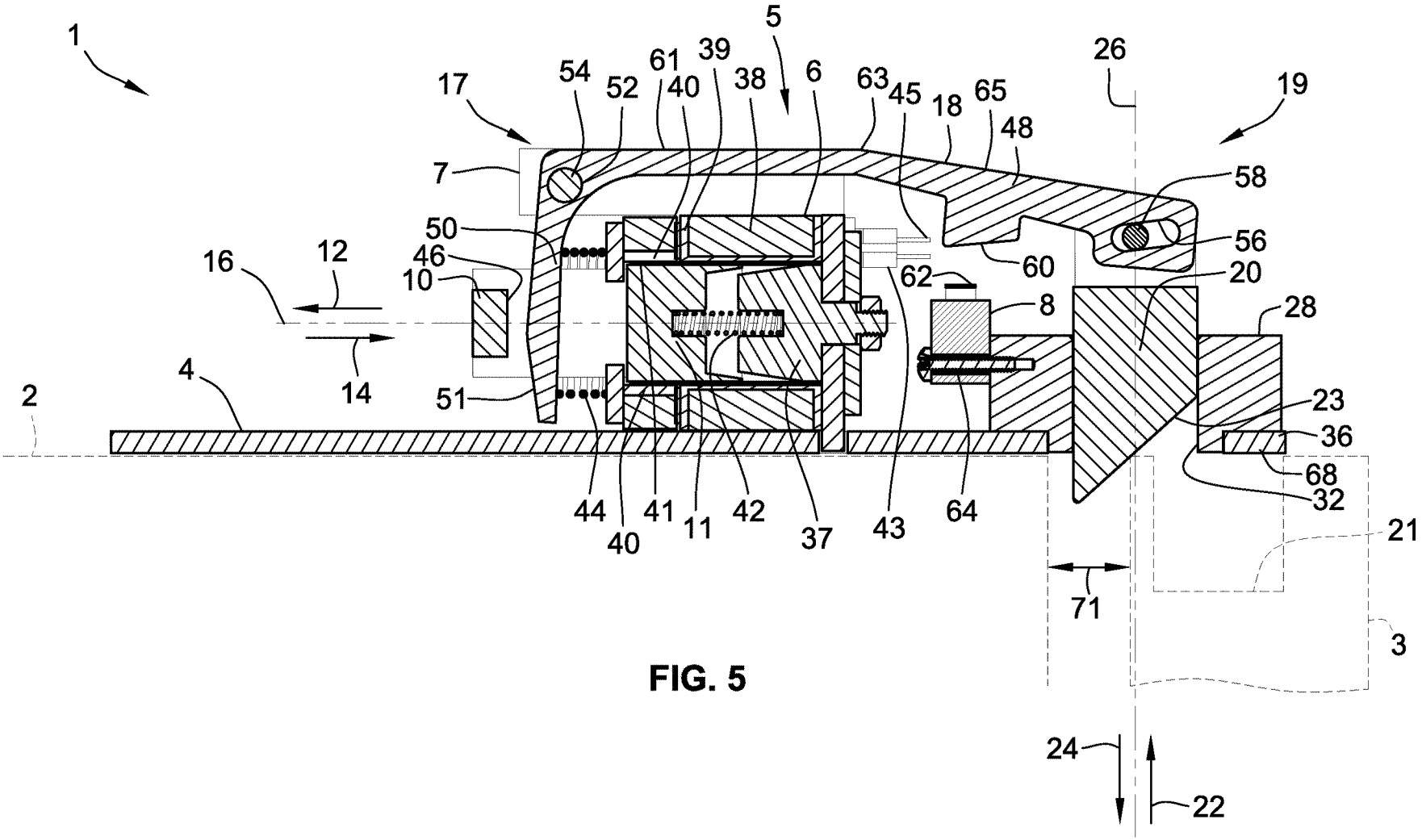
FIG. 5 is a cross-sectional view of the second side of the solenoid actuated locking system of FIG. 3 in a locked position while a force is being applied to the locking pin.

Turning to another feature of the locking system 1 of the present application, as illustrated in FIG. 5, when the locking mechanism 5 enters the locked position (see FIGS. 3-4) when the door 3 of the device 2 is open the door 3 of the device 2 can still be closed and locked while the locking mechanism 5 remains in the locked position (see FIGS. 3-4) by shutting the door 3 with sufficient force to overcome the biasing force of the spring 44 that is biasing against the arm 50 of the bell crank 18 when the locking mechanism 5 is in the locked position (see FIGS. 3-4).

For example, as illustrated in FIG. 5, if the locking mechanism 5 is in the locked position (see FIGS. 3-4) and a user closes the door 3 of the device 2 the door 3 will make contact with the angled portion 23 of the locking pin 20. In order for a user to shut the door 3 of the device 2 when the locking mechanism 5 is in the locked position (see FIGS. 3-4) a user must decrease the distance 71 between the door 3 and the device 2 by applying more and more force to the door 3 as it makes contact with the angled portion 23 of the locking pin 20 in order to drive the locking pin 20 in the first direction 22 along the second axis 26 and overcome the biasing force of the spring 44 that acts upon the locking pin 20 when the locking mechanism 5 is in the locked position (see FIGS. 3-4).

If enough force is applied by the user when closing the door 3 to overcome the biasing force of the spring 44 then the door 3 will make contact with the angled portion 23 of the locking pin 20 and the locking pin 20 will be driven in the first direction 22 along the second axis 26 until the locking pin 20 has been retracted enough such that the door 3 can slide under the locking pin 20.

Once the door 3 is sufficiently closed the locking aperture 21 will align with the retracted locking pin 20, which will remove the force being applied to the locking pin 20 to keep it in its retracted state.

Once the force being applied to the locking pin 20 has been removed the biasing force of the spring 44 will return to bias the arm 50 of the bell crank 18 against the stop 46 of the armature 10, which will cause the locking mechanism 5 to return to the locked position (see FIGS. 3-4) by driving the locking pin 20 into the at least partially extended state into the locking aperture 21 of the door 3 that has been aligned with the locking pin 20 as it is being driven along the second direction 24 of the second axis 26.

As will be appreciated, being able to close the door 3 of the device 2 while the locking mechanism 5 is in the locked position (see FIGS. 3-4) provides a great advantage for hotels or motels using the locking system 1 because instead of a user or staff member having to contact the staff member of the hotel or motel responsible for locking and unlocking the locking mechanism 5 and requesting that a first electrical signal be sent to unlock the locking mechanism 5, closing the door 3, then requesting a second signal be sent to lock the locking mechanism 5, a user can close and lock the door 3 of the device 2 by simply applying sufficient force to the door 3.

Another advantage of the locking system 1 of the present application is the relatively compact design that is afforded by having the locking mechanism 5 have the bell crank 18 extend over the top of the solenoid assembly 6.

As will be understood, hotel and motel rooms will typically have relatively compact devices 2, such as miniature refrigerators, to compensate for the limited living space in a hotel room. The miniaturizing of the devices 2 in hotel rooms, such as refrigerators causes the devices 2, such as a miniature refrigerator, to have a very limited amount of storage space.

Thus, one of the additional benefits of incorporating the locking system 1 of the present application in a device 2 when space is at a premium, such as in hotel rooms is that if the locking system 1 is used on the exterior surface of the device 2, such as a miniature refrigerator in a hotel, it will then not take any of the interior storage space of the device 2 and if it is implemented to be built into a device 2 it will require no additional space or in some circumstances very minimal space.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A solenoid actuated locking system comprising:

a bracket for mounting to a device;

a locking mechanism coupled with the bracket, the locking mechanism comprising:

a solenoid having an armature linearly drivable in opposite first and second directions along a first axis;

a locking pin moveable in opposite first and second directions along a second axis that is non-parallel to the first axis between a locked position and an unlocked position;

a bell crank having a shaft portion and an arm coupled to the shaft portion, the arm being operably coupled to the armature, the shaft portion being operably coupled to the locking pin, the bell crank being rotatably mounted about an axis of rotation for rotation in opposite first and second angular directions, when the armature is linearly driven along the first axis, the bell crank rotates about the axis of rotation, thereby moving the locking pin along the second axis; and wherein linearly driving the armature in the first direction along the first axis rotates the bell crank about the axis of rotation in the first angular direction and drives the locking pin in the first direction along the second axis to the locked position;

wherein when a force that is not generated by the bell crank is applied to the locking pin causes the locking pin to move in the second direction along the second axis toward the unlocked position, the locking pin causes the bell crank to rotate about the axis of rotation in the second angular direction without linearly driving the armature in the second direction along the first axis; and wherein when the force applied to the locking pin is removed, the locking pin moves in the first direction along the second axis toward the locked position.

2. The locking system of claim 1, wherein:

supplying a first electrical current to the solenoid linearly drives the armature in the first direction along the first axis and causes the locking pin to move to the locked position;

supplying a second electrical current to the solenoid linearly drives the armature in the second direction along the first axis and cause the locking pin to move to the unlocked position;

the first electrical current has a polarity that is opposite to a polarity of the second electrical current.

3. The locking system of claim 1, wherein the solenoid is a latching solenoid.

4. The locking system of claim 1, further comprising:

an activation switch electrically coupled to a central command center;

wherein the activation switch provides a signal to the central command center when the locking pin is in the locked position.

5. The locking system of claim 4, wherein the activation switch has a supervision tab; and wherein when the locking pin is in the locked position, the bell crank suppresses the supervision tab which sends the signal to the central command center indicating that the locking pin is in the locked position.

6. The locking system of claim 5, wherein the armature is unlatched from a stationary pole in an unlatched position.

7. The locking system of claim 1, wherein the armature couples to a stationary pole in a latched position of the armature and the stationary pole.

8. The locking system of claim 7, wherein when the armature and the stationary pole are in the latched position, the locking pin is in the unlocked position.

9. The locking system of claim 7, wherein the armature is coupled to the stationary pole in the latched position by a permanent magnet.

10. The locking system of claim 9, wherein when the armature is in the unlatched position, the locking pin is in the locked position.

11. The locking system of claim 9, wherein the armature is held in the unlatched position by a spring.

12. A method for using the solenoid actuated locking system of claim 1, comprising the steps of:

introducing a first electrical current to the solenoid of the locking mechanism to linearly drive the armature along the first axis, causing the locking pin to move along the second axis; and locking, with the locking pin, a door when the locking pin has been moved along the second axis to the locked position.

13. The method for using the solenoid actuated locking system of claim 12, further comprising:

introducing a second electrical current to the solenoid to linearly drive the armature along the first axis, causing the locking pin to move along the second axis to the unlocked position; and unlocking the door by retracting the locking pin from a locking aperture of the door when the pin has been moved along the second axis to the unlocked position.

14. The method for using the solenoid actuated locking system of claim 13, wherein the first electrical current has a polarity that is opposite to a polarity of the second electrical current.

15. The method for using the solenoid actuated locking system of claim 14, wherein the armature is latched to a stationary pole by a permanent magnet when the locking pin is in the unlocked position.

16. The method for using the solenoid actuated locking system of claim 15, wherein the armature is unlatched from the stationary pole by a spring when the locking pin is in the locked position.

17. The locking system of claim 1, wherein:

the arm is movable relative to the armature;

a spring provides a biasing force biasing the arm toward engagement with the armature; and when the locking pin is moved in the second direction along the second axis without linearly driving the armature along the first axis by the force applied to the locking pin, the biasing force of the spring is overcome by the force applied to the locking pin.

18. The locking system of claim 17, wherein:

when the force applied to the locking pin is removed, the biasing force provided by the spring rotates the bell crank in the first direction and causes the locking pin to move in the first direction along the second axis towards the locked position.

19. The locking system of claim 17, wherein:

the armature includes a slot that receives the arm therein, the slot being sized and configured to permit the arm to move therein and allow the arm to be movable relative to the armature;

the armature includes a stop adjacent the slot, the biasing force of the spring biases the arm into engagement with the stop when the force is not applied to the locking pin.

20. The locking system of claim 19, wherein:

the armature has a first position and a second position;

when is the force is not applied to the locking pin and the locking pin is in the locked position, the armature is in the second position;

when the locking pin is in the unlocked position, the armature is in the first position;

the slot is sized and configured such that when the force is applied to the locking pin, the bell crank is rotated in the second angular direction, causing the arm to move within the slot to move the locking pin from the locked position to the unlocked position while the armature remains in the second position.

21. The locking system of claim 1, wherein the rotational axis about which the bell crank rotates is fixed relative to the bracket.

* * * * *